United States Patent [19]

Squires

[11] Patent Number: 4,949,604

[45] Date of Patent: Aug. 21, 1990

[54] CARPET ATTACHING DEVICE

[76] Inventor: Daniel R. Squires, 7300 Murkins, Kansas City, Mo. 64133

[21] Appl. No.: 333,445

[22] Filed: Apr. 5, 1989

[51] Int. Cl.[5] ..... A47G 27/04; B25B 27/02

[52] U.S. Cl. ..... 81/488; 29/270

[58] Field of Search ..... 81/488; 7/103; 294/8.6; 29/235, 270, 238, 243.5; D8/15

[56] References Cited

U.S. PATENT DOCUMENTS

| | | | |
|---|---|---|---|
| 4,605,253 | 8/1986 | Anderson | 294/8.6 |
| 4,750,226 | 6/1988 | Costill | 81/488 |
| 4,790,059 | 12/1988 | Killpack | 7/103 |
| 4,797,963 | 1/1989 | Gulino | 81/488 |

*Primary Examiner*—Roscoe V. Parker

*Attorney, Agent, or Firm*—Hovey, Williams, Timmons & Collins

[57] ABSTRACT

A shiftable, roller-type, high mechanical advantage carpet device (10) is provided to facilitate the rapid and firm attachment of carpeting (44) to upstanding tack stripping (52) typically provided adjacent a baseboard (50). The device (10) preferably includes an integral metallic frame (12) presenting an obliquely oriented central handle section (26) providing ample clearance for use of the device (10) adjacent a wall or baseboard (50). The device (10) further includes a pair of spaced, fore and aft wheel assemblies (14, 16) rotatably secured to the frame (12) and adapted to contact the upper surface of carpeting (44) above the tack stripping (52). Each wheel assembly (14, 16) includes three spaced apart wheel elements (**28–32, 28*a*–32*a*) which are arranged for straddling respective tack rows (54, 56) of the tack stripping (52); in this fashion, as the device (10) is shifted along the carpet margin, the wheel elements (28–32, 28*a*–32*a*) act to press the carpeting (44) into firm interengagement with the tack rows (54, 56**).

7 Claims, 1 Drawing Sheet

CARPET ATTACHING DEVICE

BACKGROUND OF THE INVENTION

1. Field of the Invention

This invention relates to a shiftable, roller-type carpet attaching device of simple construction which allows a carpet installer to readily secure the margins of carpeting to tack stripping through a continuous, rolling movement of the device along the carpet surface. More particularly, it is concerned with such a device having an obliquely oriented, central, graspable frame together with a pair of axially spaced apart, carpet-engaging wheel sets secured to the frame and oriented for straddling respective rows of underlying tacks so as to permit ready attachment of carpeting to the tacks.

2. Description of the Prior Art

One of the final steps in the laying of carpeting is to attach the margins thereof to tack stripping, which is typically secured to the floor adjacent the baseboard of the room to be carpeted. Tack stripping normally is in the form of elongated wooden strips provided with two laterally spaced rows of upstanding, sharpened tacks. In practice, the carpet layer attempts to press the carpet margin downwardly adjacent the baseboard so as to firmly attach the carpet to the underlying, upstanding tack rows. In many cases, the carpet layer simply presses the carpeting down by hand, or may make use of crude expedients such as wooden blocks or the like. In all cases though, the goal is to firmly secure the edges of the carpeting to the tack stripping.

Prior techniques such as those described suffer from a number of defects. Thus, attempting to manually attach the carpeting to the tack stripping can be a time consuming undertaking, with indifferent results. This is particularly the case in instances where heavy, thick carpeting is being laid, because of the tendency of such carpeting to resist deformation and ready attachment to the tack stripping.

Accordingly, there is a decided need in the art for a simplified device to assist the carpet layer in securing carpeting to tack stripping in a rapid and cost effective manner.

SUMMARY OF THE INVENTION

The present invention overcomes the problems noted above, and provides a roller-type, high mechanical advantage carpet attaching device designed for the easy, continuous and secure attachment of carpeting to tack stripping. Broadly speaking, the device of the invention preferably includes a frame together with carpet-engaging structure advantageously in the form of roller means operably coupled to the frame and adapted to engage the upper surface of carpeting above tack stripping; in use, the carpet layer simply grasps the frame and shifts the device along the carpet margin so as to depress the carpeting and secure the same to the underlying tack stripping.

In particularly preferred forms, the frame is an integral metallic unit presenting an obliquely oriented, central handle section permitting placement of the device closely adjacent a baseboard as required, while still giving the user adequate hand clearance. At the same time, this construction permits the user to exert considerable downwardly directed force through the handle and roller means so as to ensure firm attachment of the carpeting to the tack stripping.

In addition, the carpet-engaging means preferably includes a pair of axially spaced apart carpet-engaging sets, each including three laterally spaced apart, juxtaposed, depending elements (typically wheel elements) defining therebetween a pair of side-by-side recesses. The elements are arranged so that the center element passes between the tack rows of underlying tack stripping, whereas the outer elements, each serving with the central element, straddle a respective tack row.

DESCRIPTION OF THE PREFERRED EMBODIMENT

Figure 2:
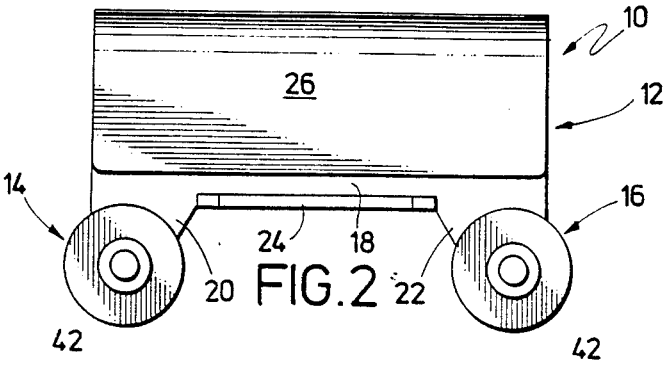
FIG. 2 is a side elevational view of the device.

Turning now to the drawing, carpet attaching device 10 in accordance with the invention broadly includes an elongated, central, rigid metallic frame 12 together with a pair of axially spaced apart, fore and aft, carpet-engaging wheel assemblies 14, 16. As best seen in FIG. 2, the respective wheel assemblies define the lowermost extremities of the device 10.

Figure 6:
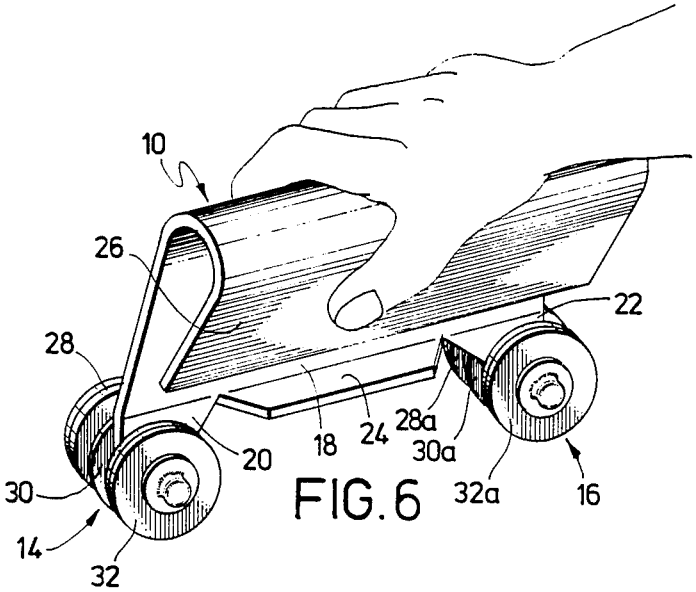
FIG. 6 is a perspective view illustrating the hand of a user grasping the device for use thereof.

In more detail, frame 12 is of integral construction and includes a lower, upright body portion 18 presenting a pair of endmost, depending, apertured, wheel assembly-receiving tangs 20, 22. A laterally extending central tab 24 extends between the tangs 20, 22 as best seen in FIG. 6. The overall frame 12 further includes a graspable handle portion broadly referred to by the numeral 26, and includes an obliquely oriented, elongated, downwardly opening metallic loop which extends upwardly from lower body 18.

Figure 1:
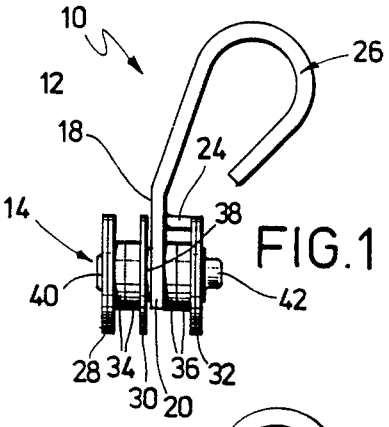
FIG. 1 is a front elevational view of a carpet attaching in accordance with the present invention.

The wheel assemblies 14, 16 are identical and each includes a total of three laterally spaced apart, juxtaposed wheel elements 28, 30 and 32 (in the case of assembly 14) and elements **28*a*, 30*a* and 32*a* (assembly 16). Inasmuch as the assemblies 14, 16 are identical, only assembly 14 will be described in detail, but it will be appreciated that such description is equally applicable to assembly 16. Referring to FIG. 1, it will be seen that the outermost elements 28, 32, are each in the form of a pair of large automotive bumper washers, whereas central element 30 is in the form of a single large bumper washer. The elements 28, 30, are separated by a pair of annular spacers 34, and similarly the element 32 is spaced from the adjacent tang 20 through a pair of annular spacers 36. Finally, it will be observed that a smaller washer 38 is interposed between central element 30 and the face of tang 20 remote from wheel element 32**.

The wheel elements 28–32, as well as the intervening spacers 34, 36 and washer 38, are rotatably secured to tang 20 by means of an axial pin 40 extending through the elements 28–32, spacers 34, 36, washer 38 and aperture of tang 20; a frictional connection cap 42 is affixed to the opposite end of pin 40 so as to secure the entire assembly in place while permitting rotation of the respective wheel elements 28–32. As will be appreciated, the pin 40 forms the axis of rotation of the wheel elements 28–32, with the angle of orientation of the handle structure 26 being oblique relative to this rotation axis.

It will be appreciated from the foregoing that the wheel assembly 14 (and of course assembly 16 as well) presents a pair of side-by-side recesses 43, 43*a* respectively between the wheel elements 28, 30 and the elements 30, 32. The importance of this arrangement will be described below.

Figure 3:
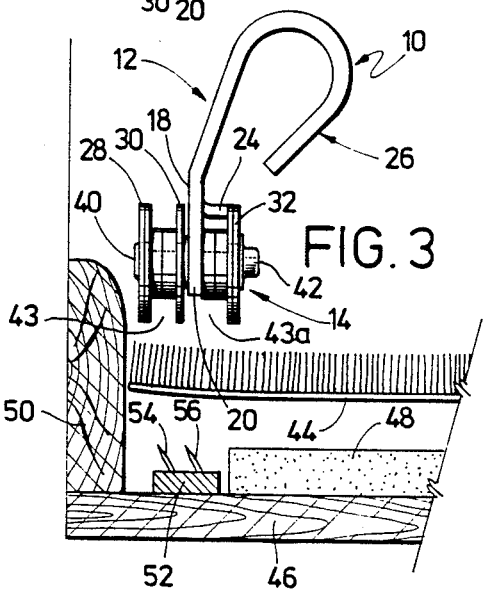
FIG. 3 is a fragmentary, exploded view illustrating the device of the invention, the marginal edge of carpeting to be laid, and the underlying subfloor, padding and tack stripping.

Attention is next directed to FIG. 3. In this view, the device 10 is shown above a carpet margin 44, the latter being above the conventional subfloor 46, carpet padding 48, and baseboard 50. In addition, tack stripping 52, affixed to subfloor 46 by any convenient means, is situated directly beneath the device 10. It will be noted in this respect that the stripping 52 includes a pair of laterally spaced apart, axially extending rows 54, 56 of attachment tacks.

Figure 4:
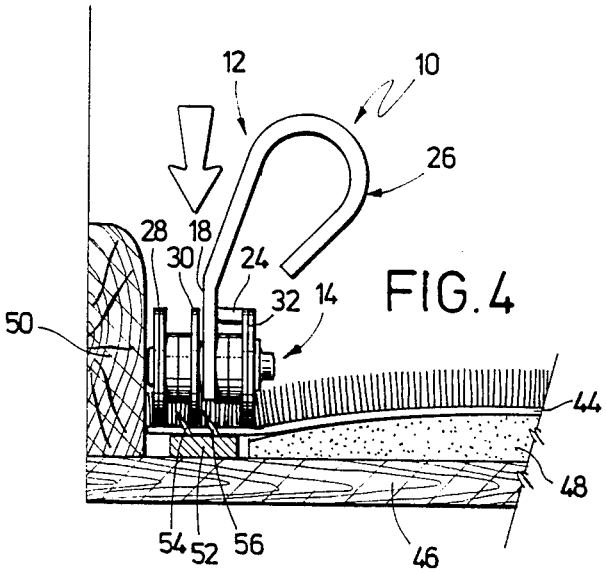
FIG. 4 is a fragmentary view similar to that of FIG. 3 but showing the operation of the device in attachment of the carpeting to the tack stripping.

The use of device 10 is best illustrated in FIG. 4. In particular, it will be seen that a downwardly directed force, exerted through handle 26, serves to press the carpet 44 firmly onto the upstanding tacks of rows 54, 56. In this connection, it will be seen that the wheel elements 28–32 are strategically located to effect a straddling relationship with the tack rows 54, 56, i.e., the row 54 enters recess 43 between wheel elements 28, 30, whereas row 56 enters recess 43*a* provided between the elements 30, 32. It will further be appreciated that as the device 10 is moved along the carpet margin 44 adjacent baseboard 50, the wheel element arrangement causes the device 10 to "seek and find" the preferred tack row straddling relationship described.

Figure 5:
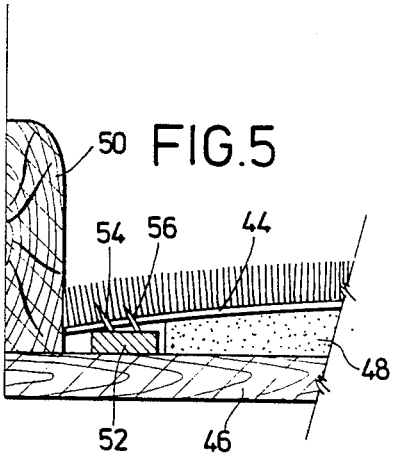
FIG. 5 is a fragmentary, sectional view illustrating the condition of the carpeting as fully attached to the tack stripping.

As illustrated in FIG. 6, the handle structure 26 is designed to facilitate placement and shifting movement of device 10 in the close quarters adjacent baseboard 50. For this reason, the handle 26 is obliquely oriented, thus giving the user hand clearance near the baseboard 50 and associated wall. At the same time, considerable downwardly directed force can be exerted through the handle structure so as to assure firm attachment of the carpeting to the tack strip. The final attached configuration of the carpeting 44 is illustrated in FIG. 5, where it will be seen that the tack rows 54, 56 pass through the base of the carpeting for the most secure attachment.

I claim:

1. A carpet attaching device for attaching carpeting presenting an upper face to tack stripping having a plurality of upstanding tacks substantially aligned therealong, said device comprising:

a frame;

roller means presenting a peripheral surface for engaging the carpet upper surface, said roller means including two parallel wheels spaced apart from one another for straddling tacks as said device axially rolls along the tack stripping; and means rotatably coupling said roller means and said frame with at least a portion of said peripheral surface extending therefrom, said frame presenting graspable means for grasping by a user of said device for placing said peripheral surface portion into depressing engagement with the carpet upper face, and for rollably moving said device axially along the tack stripping with the carpet therebetween in order to secure the carpet to the tack stripping.

2. The device of claim 1, wherein upper portions of said graspable means are rounded.

3. The device of claim 2, wherein said graspable means forms an elongated, downward facing, open loop.

4. The device of claim 1, said roller means being rotatable about a rotation axis, said graspable means including an upright portion oriented at an oblique angle relative to said rotation axis.

5. A carpet attaching device for attaching carpeting to tack stripping which includes two substantially parallel rows of upstanding tacks, the device comprising:

a frame; and carpet-engaging means coupled to said frame and including three laterally spaced apart, juxtaposed, depending elements defining therebetween a pair of side-by-side recesses, said elements being oriented for contacting said carpeting above said tack rows with the center element between the tack rows and with the outer elements, each serving with the center element, to straddle a respective tack row.

6. A carpet attaching device for attaching carpeting presenting an upper face to tack stripping having a plurality of upstanding tacks substantially aligned therealong, said tacks being divided into two laterally spaced apart, longitudinally extending rows along the length of said stripping, said device comprising:

a frame;

roller means presenting a peripheral surface for engaging the carpet upper surface; and means rotatably coupling said roller means and said frame with at least a portion of said peripheral surface extending therefrom, said frame presenting graspable means for grasping by a user of said device for placing said peripheral surface portion into depressing engagement with the carpet upper face, and for rollably moving said device axially along the tack stripping with the carpet therebetween in order to secure the carpet to the tack stripping, said roller means including a first set of three parallel, laterally spaced apart wheels, the intermediate wheel in oriented for disposition between the two rows of tacks and the outer wheels being oriented for closely straddling the rows of tacks as the device rolls axially along the tack stripping.

7. The device of claim 6, wherein said roller means further includes a second set of three parallel wheels axially aligned with said first set and oriented in the same fashion relative to said tack rows.

* * * * *